United States Patent [19]

Pudney et al.

[11] Patent Number: 4,721,043

[45] Date of Patent: Jan. 26, 1988

[54] TRACK GUIDED TRANSPORTATION SYSTEM

[75] Inventors: Jack L. Pudney, Dandenong; Richard M. Baird, East Malvern, both of Australia

[73] Assignee: Bridge & Plate Constructions Pty., Ltd., Dandenong, Australia

[21] Appl. No.: 833,830

[22] Filed: Feb. 25, 1986

[30] Foreign Application Priority Data

Mar. 1, 1985 [AU] Australia ..... PG9534

[51] Int. Cl.[4] ..... B61B 13/04; E01B 25/12

[52] U.S. Cl. ..... 104/121; 104/130; 105/147

[58] Field of Search ..... 104/121, 172 BT, 130, 104/288, 287, 247, 172.2; 105/146, 147; 414/181

[56] References Cited

U.S. PATENT DOCUMENTS 3,759,187 9/1973 Gayot ..... 104/130

4,620,486 11/1986 Grohau et al. ..... 105/147

*Primary Examiner*—Robert B. Reeves

*Assistant Examiner*—John Pido

*Attorney, Agent, or Firm*—Schmidt, Johnson, Hovey & Williams

[57] ABSTRACT

A track guided transportation system for shelf servicing within warehouses. A lower guide track provides a narrow channel defined between a track bottom face and a pair of track side faces, and an upper guide track extends above and parallel to the lower guide track. A transportation vehicle with a plurality of mounting assemblies is mounted to and between the lower and upper tracks for travel therealong. Each mounting assembly of the lower guide track includes a single supporting wheel for rolling centrally along the track channel on the bottom face to support the vehicle and at least one stabilizing element is provided in the track channel extending generally between the inner side faces and engaging one or other of the side faces at any one time in order to laterally stabilize the vehicle. Each mounting assembly of the lower guide track also includes at least one guide element selectively engageable with the lower guide track at track junction regions so as to directionally steer each mounting assembly and thus the vehicle through the junction regions.

23 Claims, 3 Drawing Figures

TRACK GUIDED TRANSPORTATION SYSTEM

FIELD OF THE INVENTION

This invention relates generally to a track guided transportation system, and in particular to a system in which a vehicle is guided for transportation between lower and upper guide tracks. The system is applicable for installation in corridors of warehouses and the like where vehicles can service shelves along the corridors for stocking and retrieving goods. It will be convenient to hereinafter describe the transportation system in relation to the exemplary application, although it should be appreciated that the invention is not limited to that application.

DESCRIPTION OF THE PRIOR ART

A number of shelf servicing transportation systems have been developed and installed in warehouses. Such systems generally include a lower guide track, and an upper guide track extending above and parallel to the lower guide track. Typically, the tracks are provided by rails respectively mounted for use at or adjacent the floor and roof of a warehouse along and/or between narrow corridors defined by shelves. These systems also include a transportation vehicle having bogies through which the vehicle is mounted to and between the tracks for travel therealong.

Where the tracks are arranged into sections with junction regions, these vehicles also have a switching or steering facility for moving the vehicle through the junction regions into selected track sections. That facility is usually included in or associated with one or more of the vehicle bogies.

In one transportation system, the steering facility includes at least one auxiliary U-shaped guide track running parallel to and adjacent a U-shaped lower guide track only at the junction regions, and at least one guide element coupled to the or a respective vehicle bogie mounting that vehicle to the lower guide track. The guide element is selectively engageable in the auxiliary guide track so that when engaged the vehicle can move through the junction region in a direction toward one respective track section and when not engaged can move through the junction region in a direction toward another one respective track section. Other guide elements are coupled to the or each bogie mounting the vehicle to the upper guide track and all guide elements are controlled synchronously to avoid divergence between the lower and upper guide track vehicle bogies at the junction regions.

A disadvantage of this steering facility is that the vehicle bogies are not accurately guided laterally of the tracks at the junction regions. As such, the vehicle may have difficulty in negotiating those regions.

In another transportation system, the steering facility includes providing the or each lower track bogie with a bogie wheel which runs on the head of a track rail and one or more guide rollers arranged laterally of the bogie wheel to selectively engage the railhead on one side or the other at the junction regions to steer the vehicle through the regions. The or each bogie wheel is flanged and, at the junction regions, the track railhead is slotted to accommodate the wheel flanges. In this way, the vehicle bogies are laterally stabilized at those junction regions. Again, guide elements are coupled to the or each bogie mounting the vehicle to the upper guide track and those guide elements and the guide rollers are controlled synchronously.

This steering facility goes partway toward laterally stabilizing the vehicle at the track junction regions. However, stability could be improved, particularly in systems having large spacings between the upper and lower tracks.

SUMMARY OF THE INVENTION

It is an object of the present invention to provide a relatively simple transportation system having improved lateral stability in the vehicle thereof.

According to the present invention there is provided a track guided transportation system including: a lower guide track having a channel extending therealong defined between a track bottom face and a pair of opposing track inner side faces upstanding from the bottom face; an upper guide track extending above and parallel to the lower guide track; and, a transportation vehicle having a plurality of mounting assemblies through which the vehicle is mounted to and between the lower and upper tracks for travel therealong, each mounting assembly of the lower guide track including at least on supporting element for moving along in the track channel on the bottom face to support the vehicle during travel, and at least one stabilizing element for moving along in the track channel engaging the or each inner side face to laterally stabilise the vehicle during travel, each mounting assembly of the lower guide track also including at least one guide element selectively engageable with the lower guide track at track junction regions to directionally steer each mounting assembly of the lower guide track and thus steer the vehicle through the junction regions.

This invention is disclosed herein with reference to the transportation system ina normal use orientation on a horizontally extending foundation, and terms such as "lower" and "upper" should be construed in the light of this orientation. However, it is to be appreciated that other orientations may be equally possible and that consequential changes in terms such as those above may be required in the light of those other orientations for a proper and complete understanding of the invention.

Preferably, the stabilising element of the mounting assembly of the lower guide track is positioned adjacent the supporting wheel. In this way the stabilizing element leads the supporting wheel during travel in a direction toward and through junction sections having a plurality of track sections extending away therefrom. The at least one guide element of the mounting assembly of the lower guide track is preferably positioned adjacent the at least one leading stabilizing element.

The lower guide track preferably has a pair of track outer side faces spaced outwardly from respective inner side faces. The guide elements are preferably arranged to selectively engage these outer side faces. The lower guide track may be square U-shaped in transverse cross-section, the bottom of the U providing the bottom face and the legs of the U each providing one inner and outer side face.

Preferably, the guide elements are selectively movable for engagement with and disengagement from the track outer side faces. Preferably, the guide elements are arranged so that engagement will occur only at the junction regions.

Preferably, the mounting assembly of the lower guide track includes a plurality of guide elements. At least one guide element is preferably selectively movable for engagement with each respective associated track outer side face. Moreover the guide elements of the mounting assembly of the lower guide track are preferably coupled together for simultaneous movement. In this way as the guide element associated with one track outer side face moves for engagement, the guide element associated with the other track outer side face moves for disengagement. The mounting assembly of the lower guide track may include a linkage coupling the guide elements thereof together.

Preferably, each guide element includes a guide roller for roll engaging the lower guide track. The guide roller may be mounted on a support axle for rotation, the support axle being mounted for selective movement to move the guide roller for engagement with and disengagement from the lower guide track. Each support axle may be slidably mounted for longitudinal movement to move the guide roller mounted thereon for engagement with and disengagement from the lower guide track.

The mounting assembly of the lower guide track may include a pair of stabilizing elements located one in front of and one behind the supporting wheel having regard to a direction of travel along the lower guide track. Four guide elements, may be provided on the mounting assembly two each being adjacent a respective stabilizing element. The stabilizing element may be a stabilizing roller mounted for rotation about a vertical axis so as to roll along the lower guide track inner side faces.

Preferably the upper guide track has a channel defined between a track bottom face and a pair of opposing track inner side faces depending from the bottom face. The mounting assembly of the upper guide track preferably includes at least one stabilizing element in the track channel extending generally between the inner side faces and engaging one or other of the upper side faces at any time in order to laterally stabilize the vehicle during travel. Each such mounting assembly preferably also includes at least one guide element selectively engageable with the upper guide track at track junction regions to directionally steer the mounting assembly of the upper guide track.

The transportation vehicle preferably includes a frame structure on which the mounting assemblies are provided. Preferably, that frame structure includes a lower frame section for location adjacent the lower track, an upper frame section for location adajcent the upper track, and a riser frame section extending between and rigidly interconnecting the lower and upper frame sections. The lower and upper frame sections are preferably each elongate in a direction along the tracks which the vehicle is mounted thereon. The riser frame is preferably also elongate and extends longitudinally between the lower and upper frame sections, at least substantially perpendicular thereto.

The transportation vehicle may include a pair of mounting assemblies on each of the lower and upper frame sections at respective end regions thereof. Each mounting assembly may be movably connected to the respective frame section so that the assemblies can accommodate changes in track direction during vehicle travel, particularly steerage through the track junction regions. To that end, each mounting assembly may be mounted to the frame sections for pivoting about an axis extending perpendicular to the plane of the lower track, i.e. vertically in the example application.

The transportation vehicle preferably also includes a stock carrying unit mounted on the frame structure to support and carry stock and/or personnel during vehicle travel. In the example application, it is this unit that supports stock carried to and from the storage shelves. The stock carrying unit is preferably mounted on the riser frame section for linear movement therealong between the lower and upper frame sections. The stock carrying unit preferably has one or more support platforms on which stock and/or personnel can be carried.

The transportation vehicle preferably also includes controllable drive means for moving the vehicle along the guide tracks and also for moving the stock carrying unit along the riser frame section.

The following description refers to a preferred embodiment of the transportation system of the present invention. To facilitate an understanding of the invention, reference is made in the description to the accompanying drawings where the system is illustrated. It is to be understood that the system is not limited to the embodiment as hereinafter described and as illustrated.

DETAILED DESCRIPTION OF THE PREFERRED EMBODIMENT

Figure 1:
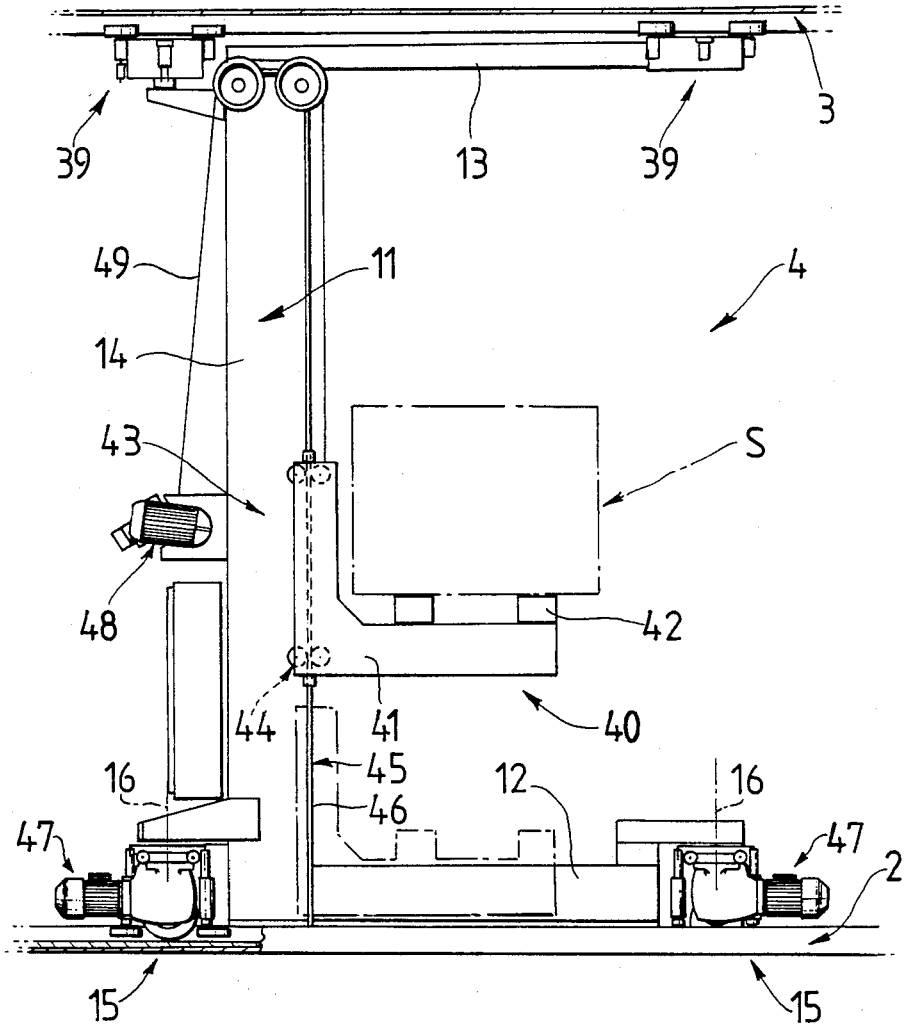
FIG. 1 is a side elevation outline of a preferred embodiment of the transportation system of the present invention.

Referring initially to FIG. 1, of the drawings, there is generally illustrated transportation system 1, suitable for installation within corridors defined between warehouse shelving (not illustrated) and operable to stack and retrieve stock S, from the shelving. System 1, includes parallel, spaced apart lower and upper guide track rails 2,3, mounted adjacent the floor and roof of the warehouse respectively. In particular, sections of rails 2,3, can extend along and between the corridors with junction regions interconnecting those sections. Transportation vehicle 4, is mounted between rails 2,3, for travel therealong and carrying stock S, to be stacked on and retri3eved from the shelving.

Lower and upper guide track rails 2,3, may have any suitable profile providing track bottom 5, and side faces 6, and to that end they may be square U-shaped with lower track rail 2, being upright and upper track rail 3, being inverted. Thus, the bottom of the U provides bottom wall 5, of each track 2,3, whilst the legs of the U provide side walls 6, of each track 2,3,. Each track bottom 5, provides bottom face 7, whilst each side wall 6, provides inner face 8, and outer face 9. Bottom face 7, and inner faces 8, of each rail 2,3, together define track channel 10.

At track juncture regions (not illustrated) sections of track rails 2,3, will converge and/or diverge. That convergence and divergence will conveniently be through curving at least one rail section toward or away from another rail section respectively, the angle at rail section juncture being acute. At rail section juncture within the junction regios, sections of track rails 2,3, will be shaped so that there is continuity between rail section channels 10, to permit unimpeded movement of vehicle 4, therebetween.

Transportation vehicle 4, includes frame structure 11, which may be of a fabricated rigid construction. Frame structure 11, includes lower frame section 12, adjacent lower track rail 2, upper frame section 13, adjacent upper track rail 3, and riser section 14, rigidly interconnecting lower and upper frame sections 12,13.

Lower and upper frame sections 12,13, are elongate in a direction along track rails 2,3. Riser frame 14, is elongate and extends longitudinally between frame sections 12,13, at least substantially perpendicular thereto. Frame sections 12, 13, and 14, are conveniently constructed of beam and plate components.

Transportation vehicle 4, includes a pair of mounting assemblies 15, on lower frame section 12, at respective end regions thereof. Each assembly 15, is of substantially identical construction, with one assembly being illustrated in detail in FIGS. 2 and 3.

Each mounting assembly 15, is movably connected to lower frame assembly 12, so that assemblies 15, can accommodate changes in track direction during vehicle travel, particularly steerage through track junction regions. To that end, each assembly 15, is mounted to lower frame section 12, for pivoting about vertical axis 16.

Each mounting assembly 15, includes mounting frame 17, by which assembly 15, is pivotably connected to frame section 12. Connection is through suitable stub shaft 18, fixed on mounting frame 17, and journalled in bearing unit 19, fixed on frame section 12.

Each mounting assembly 15, includes single supporting wheel 20, on mounting frame 17, for rolling along track channel 10, to support vehicle 4, during travel. Supporting wheel 20, is mounted on support axle 21, which in turn is connected to mounting frame 17, with axle 21, having axis 22, extending transverse of the direction of vehicle travel and extending within the plane of mounting assembly pivot axis 16. Each mounting frame 17, is conveniently shaped so as to define downwardly opening wheel chamber 23, into which respective wheel 20, is substantially housed and depends from, to project into, track channel 10.

Each mounting assembly 15, includes at least one stabilizing element 24, for moving along in track channel 10, engaging side faces 8, to laterally stabilise vehicle 4, during travel. Each stabilizing element 14, is mounted on mounting frame 17, and includes stabilizing roller 25. Each stabilizing roller 25, is sized, diametrically, relative to the lateral extent of track channel 10, so as to extend substantially across channel 10, but provide a small clearance between roller 24, and inner side faces 8. This clearance allows each roller 25, to roll engage respective inner side faces 8, should associated supporting wheel 20, deviate toward those side faces 8, and thereby inhibit further deviation.

Each stabilizing roller 25, is mounted on support axle 26, which in turn is connected to mounting frame 17. Each roller 25, may be rotatably journalled on respective axle 26, through suitable bearings 27, and axles 26, may be rigidly connected to mounting frame 17.

A pair of stabilizing rollers 24, can be provided on each mounting assembly 15, (as illustrated). Rollers 25, can then be positioned one in front of and one behind supporting wheel 20. In this way, one stabilizing roller 25, will lead supporting wheel 20, toward and through junction regions during vehicle travel regardless of the direction of that travel.

It should be appreciated, however, that in an alternative embodiment of transportation system 1, only a single stabilizing element 24, need be provided in each mounting assembly 15. Such a single stabilizing element 24, will be located in front of respective supporting wheel 20, as previously described. That single element 24, may limit the travel direction of vehicle 4, particularly through some junction regions such as those in which track sections converge and diverge in more than one direction.

Each mounting assembly 15, also includes at least one guide element 28, selectively engageable with track rail 2, at track junction regions to directionally steer each mounting assembly 15, through those junction regions. Each guide element 28, is mounted on respective mounting frame 17, and includes guide roller 29. Each guide roller 29, is mounted on respective support axle 30, which in turn is connected to respective mounting frame 17. Guide rollers 29, are conveniently rotatably journalled on support axles 30, through suitable bearings 31, and axles 30, are connected to mounting frames 17, to allow movement of guide rollers 29, relative thereto for engagement with and disengagement from track outer side faces 9.

Figure 2:
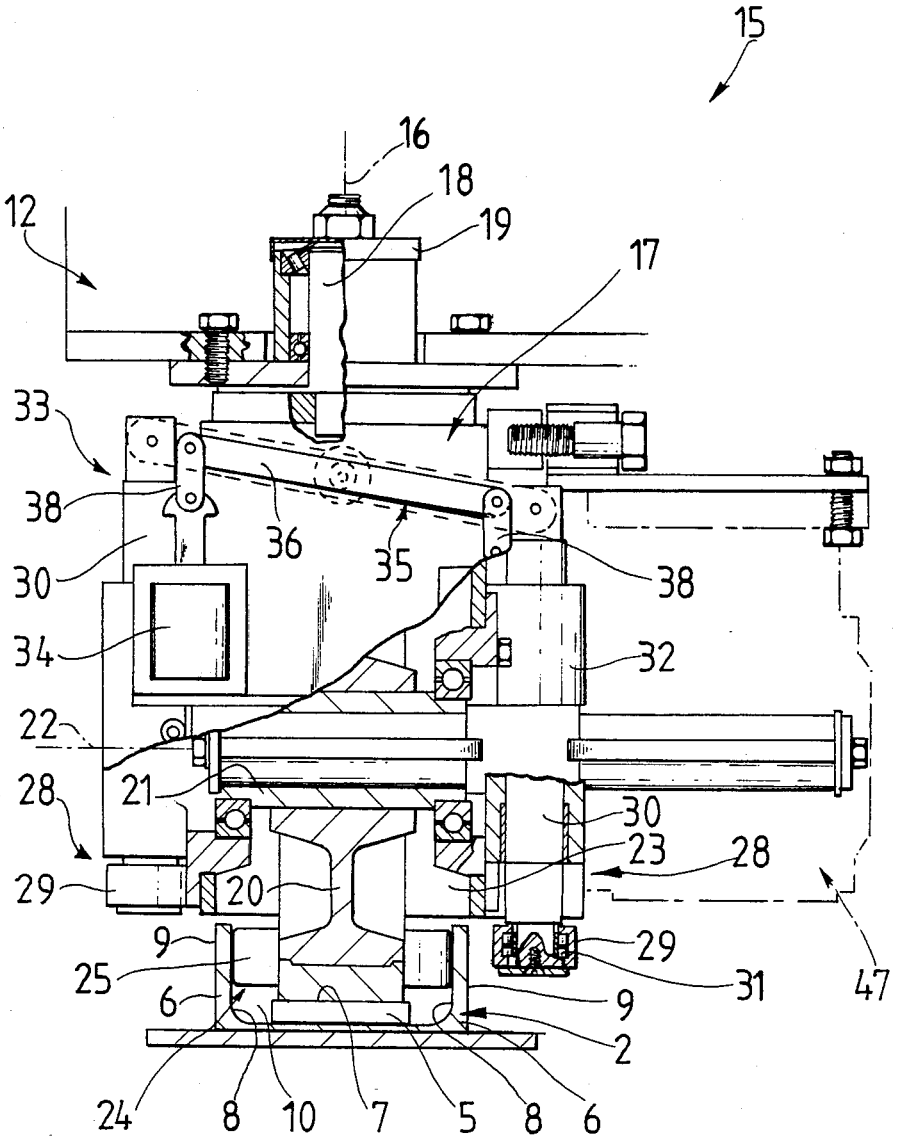
FIG. 2 is a front part section elevation of one mounting assembly of the lower guide track of the transportation system vehicle of FIG. 1; and, FIG. 3 is a side part sectional elevation of the mounting assembly of FIG. 2.
Figure 3:
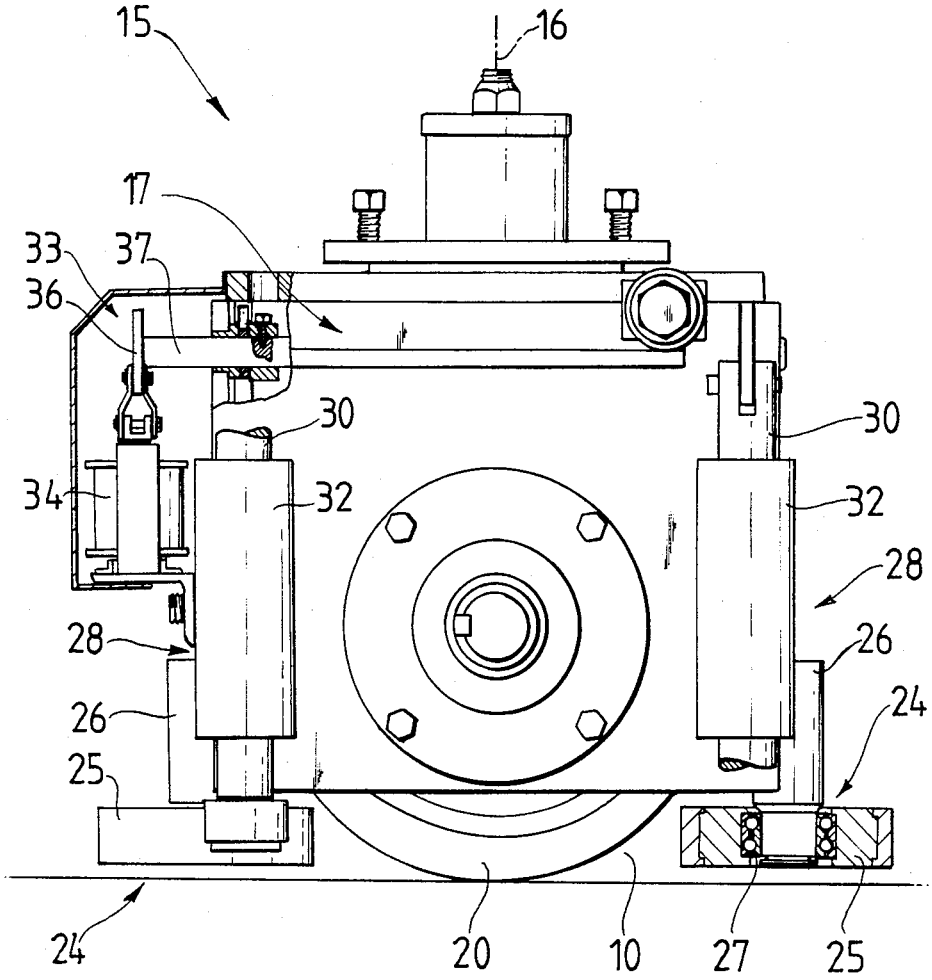

Support axles 30, are mounted for moving rollers 29, between a disengagement position remote from respective outer side face 9, (as illustrated by left hand guide element 28, in FIG. 2) and an engagement position adjacent respective outer side face 9, (as illustrated by right hand side guide element 28, in FIG. 2). In the disengagement position, rollers 29, cannot engage with track rail 2, even at junction regions during use of system 1. In the engagement position, rollers 29, are also generally spaced from respective side faces 9, between the junction regions, and come into engagement with side faces 9, only as a result of a track section diverging into the path of the oncoming guide rollers 29. In this way, guide roller engagement with side faces 9, occurs only at the junction regions as necessary to deflect or steer mounting assemblies 15, into a selected track section leading from the junction regions.

Each support axle 30, for guide rollers 29, is mounted for linear movement to move rollers 29, that linear movement being along the longitudinal axis of axles 30, and thus along a rolling axis of rollers 29. Thus, during system use, support axle movement raises guide rollers 29, above track outer side faces 9, into the disengagement position and lowers rollers 29, to beside side faces 9, in to the engagement position. To achieve that movement, support axles 30, are slidably journalled in bearings 32, mounted on frame 17.

If only one guide element 28, (not illustrated) is provided in each mounting assembly 15, then steerage is limited. In particular, through junction regions having multiple track sections leading therefrom, each assembly 15, is limited to travelling generally straight ahead through the reigon or turning toward track outer side face 9, with which guide element 28, engages. To increase steerage of each assembly 15, to turn toward either track side face 9, at least two guide elements 28, are provided in each assembly 15, one each associated with respective track side face 9. Further steerage flexibility may be gained through the provision of four such guide elements 28, (as illustrated), one pair associated with each respective track outer side face 9, one guide element 24, of each pair being located in front of respective supporting wheel 20, and the other of each pair being behind supporting wheel 20.

Movement of guide elements 28, might be achieved manually. Preferably, however, actuating mechanism 33, is included in each mounting assembly 15. Each mechanism 15, mechanically and/or electrically causes guide roller movement. In that regard, each mechanism 33, includes at least one electromechanical solenoid 34, coupled to support axles 30, of guide elements 28; a pair of single acting solenoids 34, is provided as illustrated, each acting to move guide elements 28, into a respective one of the disengagement and engagement positions. Where two or more guide elements 28, are provided (as illustrated) in each mounting assembly 15, then all elements 28, are coupled together through linkage 35, so as to move simultaneously, all rollers 29, associated with one outer side face 9, to the engagement position as all rollers 29, associated with other outer side face 9, move to ther disengagement position. In this way, inadvertent fouling between guide rollers 29, and track 2, is minimized. Each linkage 35, may comprise a pair of rocker links 36, rigidly interconnected through pivot shaft 37, support axles 30, of each pair of guide elements 28, being connected to a respective rocker link 36, through shackle links 38.

Transportation vehicle 4, also includes a pair of vehicle mounting assemblies 39, on upper frame section 13. Assemblies 39, are provided at respective end regions of frame section 13, immediately above assemblies 15. Assemblies 39, are generally of the same construction as assemblies 15, as so far described. However, assemblies 39, need not include supporting wheel 20, and each assembly 39, need only have two guide elements 29, one each associated with a respective outer side face 9, of upper track rail 3.

Transportation vehicle 4, also includes stock carrying unit 40, mounted on frame structure 11, to support stock S, during vehicle travel. Unit 40, is mounted on riser frame section 14, for linear movement therealong between frame sections 12, and 13. Unit 40, includes unit frame 41, mounted on riser frame section 14, for that movement and that frame 41, provides horizontal support platform 42, for support of stock S.

Load carrying unit 40, also includes running gear 43, by which frame 41, is movably mounted on riser frame section 14. Running gear 43, includes sets of running wheels 44, mounted on frame 41, and running track 45, mounted along riser frame section 14, and against which wheel sets 44, run during raising and lowering of load carrying unit 40. Running track 45, has opposed track surfaces 46, with each wheel set 44, being arranged to receive track 45, therebetween so that the wheels thereof run on one or other of track surfaces 46.

Transportation vehicle 4, also includes controllable drive means for moving vehicle 4, along track rails 2,3, and also for moving load carrying unit 40, along riser frame section 14. That drive means includes drive motors 47, drivingly coupled to respective supporting wheels 20, of mounting assemblies 15. Motors 47, are each mounted on respective assembly frame 17, and coupled to wheels 20, by rigidly mounting wheels 20, onto their respective support axle 21, which in turn are connected either directly or indirectly through transmission mechanisms to drive motors 47.

The drive means also includes drive motor 48, for load carrying unit 40. Motor 48, is mounted on riser frame section 14, and coupled to unit 40, through winch mechanism 49, so that motor 48, can operate mechanism 49, to pull load carrying unit 40, up riser frame section 14, and allow unit 40, to fall down section 14, under influence of gravity.

Drive motors 47, and 48, may be electrically operated.

Operation of drive motors 47, and 48, and also guide element actuating mechanisms 33, may be manual. That is, a control console may be provided for operation by a system user. That console may be located in load carrying unit 40, so that a user stands on platform 42, and moves with vehicle 4, or the console may be located remote therefrom. In an alternative, operation may be automatic and in that regard operation may be remotely controlled by a suitably programmed computer.

In using transportation system 1, vehicle 4, can travel along lower and upper track rails 2,3, being supported thereon by supporting wheels 20, and stabilizing elements 24. In particular, supporting wheels 20, act to physically support vehicle 4, on lower guide rail 2, and also drive vehicle 4, therealong. Stabilizing elements 24, provide vehicle 4, with lateral stability so that should supporting wheels 20, tend to deviate within channel 10, of track rail 2, as a result of mounting assembly pivot, then stabilizing rollers 25, engage inner side faces 8, of track rail 2, to limit that deviation.

In vehicle travel along track rails 2,3, between junction regions, guide elements 28, will be spaced clear of outer side faces 9, and play no part in the movement of mounting assemblies 15, and 19. However, as vehicle 4, approaches a junction region, guide rollers 29, may be moved as necessary into their engagement or disengagement position to cause steering of mounting assemblies 15, and 39, through that junction. That steering results from guide rollers 29, either engaging or not engaging with track outer side faces 9, and so respectively pivoting or not pivoting mounting assemblies 15, and 39, about their pivot axis 16.

In moving along track rails 2,3, load carrying unit 40, may be raised and lowered as necessary. In that regard, load carrying unit 40, may be raised and lowered between storage shelves to deposit or collect stock S.

A transportation system according to the present invention provides a transportation vehicle which is quite stable on track rails. In particular, the vehicle maintains stability, including lateral stability, when travelling through track junction regions.

The transportation system of the present invention is relatively simple in construction and operation. In that regard, it is envisaged that the system will be fully automated with operation being conducted remotely by a programmed computer. This may lead to a reduction in system maintenance and operating costs, and thus in the example application, a reduction in stock storage costs in warehouses.

Finally, it is to be understood that various modifications and/or alterations may be made to the transportation system withuot departing from the ambit of the present invention defined in the claims appended hereto.

We claim:

1. A track guided transportation system comprising: a lower guide track having a narrow channel extending therealong defined between a track bottom face and a pair of opposing track inner side faces upstanding from the bottom face; and upper guide track extending above and parallel to the lower guide track; and, a transportation vehicle having a plurality of mounting assemblies through which the vehicle is mounted to and between the lower and upper tracks for travel therealong, at least one of the mounting assemblies mounting the vehicle to the lower track and at least one other of the mounting assembling mounting the vehicle to the upper track, the mounting assembly of the lower guide track including one only supporting wheel for rolling centrally along the track channel on the bottom face to support the vehicle during travel, the suporting wheel having an unflanged annular tread surface in rolling contact with the bottom face, and at least one stabilizing roller in the track channel extending generally between the inner side faces and engaging one or other of the inner side faces at any one tim e in order to laterally stailize the vehicle during travel, the stabilizing roller having an upright axis of rotation lying in a plane which intersects said support wheel and which is substantially orthogonal to the axis of rotation of said support wheel, the sum of the clearances between the outer periphery of the stabilizing roller and said inner track side faces being less than the radius of the stabilizing roller, the mounting assembly of the lower guide track also including at least one guide element selectively engageable with the lower guide track at track junction regions to directionally steer the mounting assembly of the lower guide track and thus steer the vehicle through the junction regions.

2. The transportation system as claimed in claim 1, wherein the stabilizing element of the mounting assembly of the lower guide track is positioned adjacent the supporting wheel so as to lead the supporting wheel during travel in a direction toward and through junction sections having a plurality of track sections extending away therefrom, and at least one guide element is positioned adjacent at least one leading stabilizing element.

3. The transportation system as claimed in claim 2, wherein the lower guide track has a pair of track outer side faces spaced outwardly from respective inner side faces, and the guide elements are arranged to selectively engage the outer side faces.

4. The transportation system as claimed in claim 3, wherein the lower guide track is square U-shaped in transverse cross-section, the bottom of the U providing the bottom face and the legs of the U each providing one inner and outer side face.

5. The transportation system as claimed in claim 3, wherein the guide elements are selectively movable for engagement with and disengagement from the track outer side faces, engagement occurring only at the junction regions.

6. The transportation system as claimed in claim 3, wherein the mounting assembly of the lower guide track includes a plurality of guide elements, at least one guide element being selectively movable for engagement with each respective associated track outer side face, the guide elements of the mounting assembly of the lower guide track being coupled together for simultaneous movement so that as the guide element associated with one track outer side face moves for engagement therewith, the guide element associated with the other track outer side face moves for disengagement therewith.

7. The transportation system as claimed in claim 6, wherein the mounting assembly of the lower guide track includes a linkage coupling the guide elements thereof together.

8. The transportation system as claimed in claim 1, wherein each guide element includes a guide roller for rollable engagement with the lower guide track, and a support axle on which the guide roller is mounted for rotation, the support axle being mounted for selective movement to move the guide roller for engagement with and disengagement from the lower guide track.

9. The transportation system as claimed in claim 8, wherein each support axle is slidably mounted for longitudinal movement to move the guide roller mounted thereon for engagement with and disengagement from the lower guide track.

10. The transportation system as claimed in claim 1, wherein the mounting assembly of the lower guide track further includes an actuating mechanism operable for moving at least one guide element for engagement with and disengagement from the lower guide track.

11. The transportation system as claimed in claim 10, wherein actuating mechanism includes at least one electromechanical solenoid, and a linkage interconnecting the solenoid and the at least one guide element.

12. The transportation system as claimed in claim 3, wherein the mounting assembly of the lower guide track includes a pair of stabilizing elements located one in front of and one behind the supporting wheel having regard to a direction of travel along the lower guide track, and four guide elements, two each being adjacent a respective stabilizing element.

13. The transportation system as claimed in claim 1, wherein at least one stabilizing element is a stabilizing roller mounted for rotation about a vertical axis so as to roll along one or the other of the lower guide track inner side faces.

14. The transportation system as claimed in claim 1, wherein the upper guide track has a narrow channel extending therealong and defined between a track bottom face and a pair of opposing track inner side faces depending from the bottom face, and the mounting assembly of the upper guide track includes at least on stabilizing element in the track channel extending generally between the inner side faces and engaging one or other of the upper side faces at any one time in order to laterally stabilize the vehicle during travel, and at least two guide elements selectively engageable with the upper guide track at track junction regions to directionally steer the mounting assembly of the upper guide track.

15. A track guided transportation system comprising: a lower guide rail, square U-shaped in transverse cross section so as to present a narrow channel extending along the rail, the bottom of the U providing a bottom face and the legs of the U each providing a pair of opposing inner side faces and outer side faces spaced outwardly from respective inner side faces; an upper guide rail extending above and parallel to the lower guide rail; and, a transportation vehicle having a plurality of mounting assemblies through which the vehicle is mounted to and between the lower and upper rails for travel therealong, at least one of the mounting assemblies mounting the vehicle to the lower rail and at least one other of the mounting assemblies mounting the vehicle to the upper rail, the mounting assembly of the lower guide rail including one only supporting wheel for rolling centrally along the rail channel on the bottom face to support the vehicle during travel, the supporting wheel having an unflanged annular tread surface in rolling contact with the bottom face, and at least one stabilizing roller in the track channel extending generally between the inner side faces alternately and in rollable engagement with one or other of the inner side faces at any one time in order to laterally stabilize the vehicle durng travel, the mounting assembly of the lower guide rail also including at least one guide element selectively movable for engagement with and disengagement from the lower rail outer side face, engagement occuring only at track junction regions in order to directionally steer the mounting assembly of the lower guide rail and thus steer the vehicle through the junction regions.

16. The transportation system as claimed in claim 15, wherein the mounting assembly of the lower guide rail includes a plurality of guide elements, at least on guide elements being selectively movable for engagement with each respective associated rail outer face, the guide elements of the mounting assembly of the lower guide rail being coupled together for simultaneous movement so that as the guide element associated with one rail outer side face moves for engagement therewith, the guide element associated with the other rail outer side face moves for disengagement therewith.

17. The transportation system as claimed in claim 16, wherein the mounting assembly of the lower guide rail includes a linkage coupling the guide elements thereof together.

18. The transportation system as claimed in claim 17, wherein each guide element includes a guide roller for rollable engagement with the respective associated rail outer side face, and a support axle on which the guide roller is mounted for rotation, the support axle being mounted for selective movement to move the guide roller for engagement with and disengagement from the respective associated rail outer side face.

19. The transportation system as claimed in claim 18, wherein each support axle is slidably mounted for longitudinal movement to move the guide roller mounted thereon for engagement with and disengagement from the respective associated rail outer side face.

20. The transportation system as claimed in claim 19, wherein the mounting assembly of the lower guide rail further includes an actuating mechanism operable for moving each support axle.

21. The transportation system as claimed in claim 20, wherein the actuating mechanism includes at least one electomechanical solenoid, and a linkage interconnecting the solenoid and the support axles.

22. The transportation system as claimed in claim 21, wherein the mounting assembly of the lower guide rail includes a pair of stabilizing rollers located one in front of and one behind the supporting wheel having regard to a direction of travel along the lower guide rail and four guide rollers two each being adjacent a respective stabilizing roller.

23. The transportation system as claimed in claim 22, wherein a pair of the mounting assemblies spaced apart one behind the other mount the vehicle to the lower guide rail.

* * * * *